United States Patent [19]

Cameron

[11] Patent Number: 4,635,166

[45] Date of Patent: Jan. 6, 1987

[54] CHEMICAL EMERGENCY LIGHT

[76] Inventor: Robert W. Cameron, 7725 115th Pl. NE., Kirkland, Wash. 98033

[21] Appl. No.: 770,630

[22] Filed: Aug. 28, 1985

[51] Int. Cl.[4] ..... F21K 2/00

[52] U.S. Cl. ..... 362/34; 362/84

[58] Field of Search ..... 362/34, 84, 109

[56] References Cited

U.S. PATENT DOCUMENTS

| | | | |
|---|---|---|---|
| 1,335,520 | 3/1920 | Muller | 362/34 |
| 1,342,778 | 6/1920 | Thorne | 362/34 |
| 1,380,344 | 6/1921 | Bassett | 362/34 |
| 3,576,987 | 5/1971 | Voight | 362/34 |
| 4,064,428 | 12/1977 | Van Zandt | 362/34 |
| 4,193,109 | 3/1980 | Heffernan et al. | 362/34 |

*Primary Examiner*—E. Rollins Cross

*Attorney, Agent, or Firm*—Seed and Berry

[57] ABSTRACT

A directional chemiluminescent safety light having an internally facing reflector and a refracting lens for concentrating light in a general direction. The safety light has an adhesive back to attach the light to various objects. The color of light emitted is controllable.

20 Claims, 5 Drawing Figures

FIG. 1
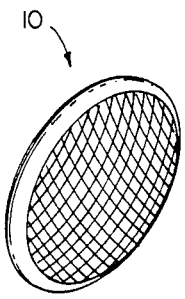
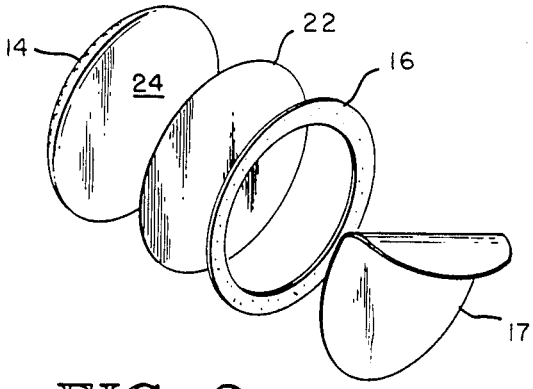
FIG. 2
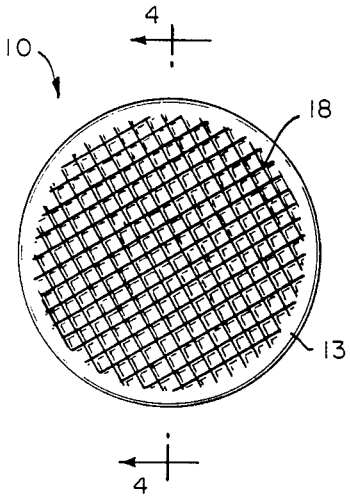
FIG. 3
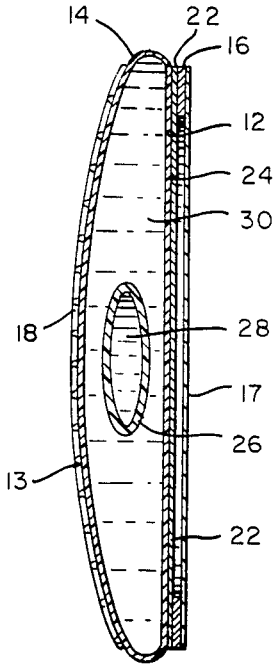
FIG. 4

CHEMICAL EMERGENCY LIGHT

DESCRIPTION

1. Technical Field

The invention relates to devices for non-electrical generation of light. More specifically, the invention relates to chemiluminescent light systems.

2. Background of The Invention

As is well known, the electrical generation of light is inconvenient or dangerous in certain applications and environments. In other applications, electrically generated light is impractical or impossible due to the difficulty in transporting or using electrical power generating equipment. Batteries have been developed to provide a portable source of electrical power but have the undesirable side effects of being excessively temperature sensitive, having relatively short shelf life and being expensive.

Chemical luminescent devices overcome many of the problems associated with electrical generation of light. For example, in bilge areas of naval vessels gasoline vapors can accumulate to dangerous levels. A small spark created by the opening or closing of an electrical switch on a flashlight can be enough to detonate this vaporous atmosphere. Chemiluminescent lighting systems rely on the reaction of chemicals at relatively low temperatures to provide illumination. Thus, a chemiluminescent light operating at temperatures well below the flash point of gasoline vapors is safe to use in the described environment.

Chemiluminescent wands, as described in U.S. Pat. No. 3,576,987, have been available commercially for some time and are often used by travelers as emergency lights and road markers. The chemiluminescent wand is superior to a flashlight for a number of reasons. The chemiluminescent light has a shelf life in excess of five years whereas the shelf life of battery operated devices are significantly less. The chemicals are usually contained in a waterproof tube thus rendering the light wand impervious to water-induced reactions such as corrosion which plague battery operated devices. Moisture caused electrical shorting is not a problem. Chemiluminescent devices are lighter in weight than battery operated flashlights and can also have operating times which exceed those of conventional battery operated flashlights. Finally, chemiluminescent devices can be constructed at a very low cost allowing the use of multiple lights in an emergency situation where the use of multiple flashlights would be impractical.

Although the chemiluminescent light has proven to be advantageous in many applications over electrically generated light, the wand shape, which is typical of such devices has limited the application of chemiluminescence. The wand shown in U.S. Pat. No. 3,576,987 requires external means to hold the light upright, for example, on a road surface if used as an emergency light. Fittings must be provided on the outside of the tube if the light is to be used in a hands-free environment as when one engages in car repair or engine work.

A further disadvantage of the wand-type device is the omnidirectional radiation pattern emitted by the wand which reduces the intensity of light that may be delivered to a specific area. Therefore, a need exists for an inexpensive luminescent device which can direct the radiation of light therefrom and which has means for allowing hands-free operation while the light is in use.

DISCLOSURE OF THE INVENTION

Therefore, it is an object of the present invention to provide a chemiluminescent light which collimates and directs the radiation of emitted light in a given direction.

It is a further object of the present invention to provide a chemiluminescent light having a shape which is readily attachable to various surfaces for allowing hands-free operation of the light.

It is a further object of the present invention to provide a chemiluminescent light which conforms in shape to conventional vehicle lights to facilitate the recognition of the light of the present invention as a hazard device.

The invention achieves these objects and other objects and advantages which will become apparent from the description which follows, by providing a chemiluminescent safety light having an internally facing reflective surface, an adhesive back and means for collimating generated light. The safety light also has means for controlling the color of light emitted therefrom to conform to various conventional electric safety signals such as vehicle marker lamps.

The safety light includes a base having a planar reflective surface on one side. A substantially transparent resilient outer dome is connected to the reflective side of the base and forms an outer compartment for a two-component chemiluminescent system. A breakable inner compartment is contained within the outer compartment and contains the first chemical component. A second chemical component is contained within the outer compartment and external to the breakable inner compartment. By squeezing the outer dome and breaking the inner compartment, the chemicals are mixed causing a chemiluminescent reaction. Light given off by the reaction is reflected off the reflective surface and through the transparent dome.

The dome can be formed with lens elements to refract the light in a general direction.

The composition of the second chemical component within the outer compartment can be selected to cause various colors of light to be transmitted through the transparent dome.

An adhesive ring is applied to the outside of the base so that the safety light can be attached to various objects.

BRIEF DESCRIPTION OF THE DRAWINGS

FIG. 1 is a perspective view of a chemiluminescent safety light in accordance with the present invention.

FIG. 2 is an exploded isometric view of the safety light of FIG. 1.

FIG. 3 is a front elevational view of the safety light.

FIG. 4 is a sectional side elevational view taken generally along line 4—4 of FIG. 3.

BEST MODE FOR CARRYING OUT THE INVENTION

Figure 5:
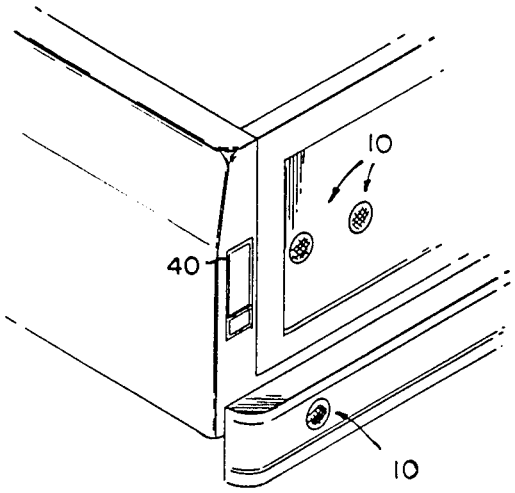
FIG. 5 is an isometric view of a stranded vehicle using the safety light.

In FIG. 1, a chemiluminescent safety light in accordance with the present invention is generally indicated by reference numeral 10. As shown in the remaining figures, the safety light has a planar base 12 and a dome-shaped or convex wall 13 forming an outer compartment 14. An adhesive ring 16 is connected to the base.

The ring has a protective paper cover 17 which can be removed to expose the adhesive ring.

The outer compartment 14 is preferably resilient and substantially transparent and can be formed from polypropylene to give the outer compartment the desired dome shape and resilient character. Prismatic lens elements 18 can be molded into the outer wall 13 of the outer compartment to refract light generated within the outer compartment in a generally outward direction. The base 12 is preferably coated with a reflective material to reflect light generated within the outer compartment through the outer wall 13. The reflective coating can be an aluminized mylar layaer 22 which adheres to the external side 24 of the base.

A breakable inner compartment 26 resides within the flexible outer compartment 14. The inner compartment can be made from glass or another fragile material and contains one component 28 of a two-component chemiluminescent system. The second chemical component 30 is contained within the outer compartment 14 and external to the inner compartment 26. The base 12 is also preferably constructed from a flexible material so that bending the light 10 will cause the inner compartment 26 to break, mixing the chemical components together. Upon mixing, a chemiluminescent reaction occurs generating light.

A first portion of the light is directly transmitted through the outer wall 13 of the dome shaped outer compartment 14. A second portion of the generated light is first reflected off aluminized layer 22 of the base and then transmitted through the outer wall. The prismatic lens elements 18, formed into the outer wall, help to collimate the light and project the light in a desired general direction. The described construction greatly increases the amount of light deliverable into a specific area from a chemiluminescent source.

The adhesive ring 16 on the external side 24 of the base facilitates use of the light in areas where both hands are needed to perform mechanical work or when it is otherwise necessary to attach the light to an object. When it is desired to adhere the safety light to a surface, the paper cover 17 is peeled off to expose the adhesive ring 16. The base 12 is then applied to the surface. The adhesive ring holds the light in place.

For example, the described safety light can be attached to a wall or bulkhead in a marine bilge so that an engine can be inspected or worked on with both hands. The use of a conventional flashlight or electric light in this environment is extremely hazardous since any spark from an opening or closing switch or heat from the electrically heated filament could ignite a potentially vapor-saturated atmosphere.

The safety light can also be directly attached to the outer garment of a jogger or road worker to warn approaching drivers at night of the user's presence. Since the light is flexible, it will not interfere with the normal movement of the garment.

As shown in FIG. 5, the described safety light can be attached to various surfaces on a vehicle to delineate the boundaries of the vehicle for safety purposes. The safety light will continue to operate without draining the vehicle battery as would the vehicle's own parking lights 40. The safety light could also be used when the vehicle battery is totally discharged. The safety light is also useful for emergency taillights, clearance lights, emergency exit lights, emergency refueling, power outages, tent lights, jogger signal lights, trail markers, home use, auto, boat and aircraft use and other uses. In short, anywhere electric power is not available or where use of electric devices is unsafe or inconvenient provides a good environment for use of the safety light.

The color of light emitted by the safety light can be controlled by the composition of the second chemical component 30 contained within the outer compartment. As is well known in the chemiluminescent art, water can be used as a regulator to control the duration and intensity of the light generated. See column 3 lines 10–15 of U.S. Pat. No. 3,576,987. In the present invention, the water is dyed to vary the frequency of light emitted through the outer wall 13. Those skilled in the art can readily determine the dye color needed to produce a red, amber or green emission from the safety light.

The chemiluminescent safety light described provides safe, convenient illumination wherever light is needed. The safety light is lightweight, wind proof, waterproof, nonflammable, non-toxic, non-corrosive and cool to handle. The described safety light, depending on the chemicals used, can last up to 8 to 12 hours after activation. The safety light is preferably stored in an unopened foil wrapper to preserve its shelf life up to five years. The safety light is more convenient to use and directs more light to the area desired to be illuminated than conventional chemiluminescent wands.

It will be appreciated that other variations and embodiments of the described invention utilizing the same general inventive principles described are contemplated. Therefore, the invention is not to be limited by the above description but is to be determined in scope by the claims which follow.

I claim:

1. A directional, light emitting chemiluminescent safety light, comprising:

a base having a planar light reflective surface;

a substantially transparent, resilient outer wall connected to the base to a side outward of the reflective surface and forming with the base a fluid-tight outer compartment for a two-component chemiluminescent system;

a breakable, fluid-tight inner compartment within the outer compartment containing the first chemical component; and a second chemical component within the outer compartment and external to the breakable inner compartment whereupon deformation of the outer wall breaks the inner compartment and mixes the chemical components, a portion of the light produced being reflected off the reflected surface and transmitted through the outer wall.

2. The safety light of claim 1 wherein the base is substantially transparent and wherein the reflective surface is on the outside of the base facing inwardly towards the resilient outer wall.

3. The safety light of claim 1 wherein the outer wall has a convex dome shape and prismatic lens elements to refract light.

4. The safety light of claim 3 wherein the periphery of the base is substantially contiguous with the periphery of the outer wall.

5. The safety light of claim 4 wherein the base and outer wall are radially disk shaped to resemble an automotive reflector.

6. The safety light of claim 1 including adhesive material on the base to a side opposite the reflective surface to attach the safety light to various objects.

7. The safety light of claim 6 wherein the base is flexible.

8. The safety light of claim 1 including means for controlling the color of light emitted from the outer wall.

9. The safety light of claim 8 wherein the second chemical component in the outer compartment includes the color controlling means.

10. The safety light of claim 9 wherein the color controlling means is dyed water.

11. A directional, light emitting chemiluminescent safety light comprising:

a flexible, fluid-tight outer compartment for a chemiluminescent system having a thin, substantially transparent convex wall and an inwardly facing reflective surface opposite the transparent wall;

an inner breakable compartment within the outer compartment containing at least one chemical component; and at least one other chemical component within the outer compartment and external to the breakable inner compartment, whereupon deformation of the outer compartment breaks the inner compartment and mixes the chemicals, a portion of the light produced being reflected off the reflective surface and transmitted through the transparent wall.

12. The safety light of claim 11 wherein the outer compartment is substantially dome shaped.

13. The safety light of claim 11 wherein the transparent wall has means for refracting light.

14. The safety light of claim 11 including means for connecting the safety light to various objects.

15. The safety light of claim 11 including means for controlling the color of the light emitted from the transparent wall.

16. A directional, two component chemiluminescent safety light having a substantially transparent, flexible outer wall and an inwardly facing reflective surface spaced from the outer wall to direct chemically generated light through the transparent wall wherein the safety light also has an inner, frangible compartment positioned in the space between the outer wall and the reflective surface to contain one of the chemical components so that substantial deformation of the flexible outer wall breaks the inner compartment, causing the chemicals to mix and generate light.

17. A directional chemiluminescent safety light, comprising:

a circular, substantially transparent and resilient convex dome connected in a spaced-apart relation to a substantially transparent flexible base, forming a fluid-tight, flexible outer compartment for a two-component chemiluminescent system;

a breakable, fluid-tight inner compartment within the outer compartment containing the first chemical component;

a second chemical component within the outer compartment and external to the breakable inner compartment whereupon deformation of the outer compartment breaks the inner compartment and mixes the chemical components producing light; and a light-reflecting surface on the outside of the base facing inwardly towards the dome to reflect part of the light towards the dome.

18. The safety light of claim 17 wherein the dome has lens elements to refract and collimate the light transmitted through the dome in a desired direction.

19. The safety light of claim 18 including an adhesive ring connected to the outside of the base for attaching the safety light to various objects.

20. The safety light of claim 19 including a removable protective backing on the adhesive ring to protect the ring until the safety light is ready for use.

* * * * *